US005804529A

United States Patent [19]

Komatsu

[11] Patent Number: 5,804,529

[45] Date of Patent: Sep. 8, 1998

[54] HEAT-SENSITIVE RECORDING MATERIAL AND PROCESS FOR THE PRODUCTION THEREOF

[75] Inventor: Yasuko Komatsu, Tokyo, Japan

[73] Assignee: Mitsubishi Paper Mills Ltd., Japan

[21] Appl. No.: 853,465

[22] Filed: May 9, 1997

[30] Foreign Application Priority Data

May 10, 1996 [JP] Japan ..... 8-116603
Apr. 2, 1997 [JP] Japan ..... 9-083921

[51] Int. Cl.[6] ..... B41M 5/40

[52] U.S. Cl. ..... 503/226; 427/152; 503/200

[58] Field of Search ..... 427/152; 503/200, 503/226

[56] References Cited

FOREIGN PATENT DOCUMENTS

| | | | |
|---|---|---|---|
| 58-38733 | 3/1983 | Japan | 503/226 |
| 58-54085 | 3/1983 | Japan | 503/226 |
| 58-104959 | 6/1983 | Japan | 503/226 |
| 59-115887 | 7/1984 | Japan | 503/226 |
| 60-112487 | 6/1985 | Japan | 503/226 |
| 60-262686 | 12/1985 | Japan | 503/226 |
| 62-48585 | 3/1987 | Japan | 503/226 |
| 62-244693 | 10/1987 | Japan | 503/226 |
| 1-180381 | 7/1989 | Japan | 503/226 |
| 4-163189 | 6/1992 | Japan | 503/226 |

*Primary Examiner*—Bruce H. Hess
*Attorney, Agent, or Firm*—Nixon & Vanderhye

[57] ABSTRACT

Disclosed is a heat-sensitive recording material in which a heat-sensitive recording layer which thermally forms a color is directly or indirectly formed on a substrate, the heat-sensitive recording layer being present between two oxygen-barrier layers each of which has a basis weight of 2 to 20 $g/m^2$, the oxygen-barrier layers being formed of a polymer substance having an oxygen permeability constant of $0.5\times 10^{-10} cm^3 \cdot cm/cm^2 \cdot sec \cdot cmHg$ or less. The heat-sensitive recording has excellent light resistance in non-printed portion thereof.

9 Claims, 2 Drawing Sheets

HEAT-SENSITIVE RECORDING MATERIAL AND PROCESS FOR THE PRODUCTION THEREOF

FIELD OF THE INVENTION

The present invention relates to a heat-sensitive recording material, and more specifically, to a heat-sensitive recording material having excellent light resistance in non-printed portions.

PRIOR ART

Generally, a heat-sensitive recording material uses a color-developing reaction between a colorless or pale colored basic leuco dye and an organic or inorganic color developer, and gives a recorded image by bringing the above two color-developing materials into contact with each other by heating them with a thermal head, a thermal pin or laser light.

The above heat-sensitive recording material is advantageous in that an apparatus therefor is simple, that the maintenance of the apparatus is easy and that no noise is made. It is therefore widely used as various kinds of printing papers, facsimile papers, recording papers for use with a recorder, and tickets. The heat-sensitive recording material has excellent characteristic features that it has a high density of a developed color and gives various hues of a developed color. When, however, it is exposed to sunlight or light from a fluorescent lamp for a long time, a non-printed portion suffers a change in color, and a recorded image portion is discolored. The heat-sensitive recording material is therefore in need of some improvements.

For overcoming the above defect, JP-A-60-112487, JP-A-62-48585 and JP-A-4-163189 disclose methods in which a coating containing an ultraviolet absorbent is formed on a heat-sensitive recording layer. When a coating containing a generally used organic ultraviolet absorbent is formed according to the above methods, however, fogging occurs in a non-printed portion presumably due to mixed melting under the conditions of 60° C. and the like.

As an embodiment using an inorganic ultraviolet absorbent, JP-A-62-244693 discloses an embodiment using titanium oxide in the form of an ultrafine powder, and JP-A-1-180381 discloses an embodiment using zinc oxide. However, these embodiments do not necessarily achieve a sufficient effect with regard to the light resistance of a non-printed portion although the light resistance of a recorded image portion may be sufficient.

As a heat-sensitive recording material improved in light resistance, chemical resistance and heat resistance of a recorded image portion, JP-A-58-38733, JP-A-58-54085, JP-A-58-104959, JP-A-59-115887 and JP-A-60-262686 disclose heat-sensitive recording materials comprising an aromatic isocyanate compound and an aromatic imino compound which forms a color by reacting with the isocyanate compound under heat. The above heat-sensitive recording materials are almost free from causing discoloration even when exposed to sunlight or light from a flurescent lamp for a long period of time. However, the color change in a non-printed portion proceeds, and the above heat-sensitive recording materials are similarly in need of some improvements.

SUMMARY OF THE INVENTION

It is an object of the present invention to overcome the above problems and provide a heat-sensitive recording material having excellent light resistance in the non-printed portion thereof.

According to the first embodiment, there is provided a heat-sensitive recording material in which a heat-sensitive recording layer which thermally forms a color is directly or indirectly formed on a substrate, the heat-sensitive recording layer being present between two oxygen-barrier layers each of which has a basis weight of 2 to 20 g/m$^2$, the oxygen-barrier layers being formed of a polymer substance having an oxygen permeability constant of $0.5\times10^{-10}$cm$^3$·cm/cm$^2$·sec·cmHg or less.

In the above heat-sensitive recording material according to the first embodiment, the heat-sensitive recording layer alone may be present between the two oxygen-barrier layers.

In the above heat-sensitive recording material according to the first embodiment, an intermediate layer and the heat-sensitive recording layer may be present between the two oxygen-barrier layers.

According to the second embodiment, further, there is provided a heat-sensitive recording material in which a heat-sensitive recording layer which thermally forms a color is directly or indirectly formed on a substrate, which heat-sensitive recording material is obtained by forming an oxygen-barrier layer formed mainly of a polymer substance on one surface of the substrate to form a laminated sheet having an oxygen permeability of 1,000 cm$^3$/m$^2$·24 hr·atm or less, then forming the heat-sensitive recording layer on the oxygen-barrier layer surface or the other surface of the substrate of the laminated sheet, and further forming other oxygen-barrier layer on the heat-sensitive recording layer surface to sandwich the heat-sensitive recording layer between the two oxygen-barrier layers, the heat-sensitive recording material having an oxygen permeability equivalent to, or smaller than, a value obtained by multiplying an oxygen permeability of the laminated sheet by 0.5.

In the above heat-sensitive recording material according to the second embodiment, the laminated sheet preferably has an oxygen permeability of 500 cm$^3$/m$^2$·24 hr·atm or less.

In the above heat-sensitive recording material according to the second embodiment, the polymer substance is preferably a polyvinyl alcohol or an ethylene-vinyl alcohol copolymer.

In the above heat-sensitive recording material according to the second embodiment, the heat-sensitive recording material may be obtained by consecutively forming, on the substrate, the first oxygen-barrier layer, the heat-sensitive recording layer and the second oxygen-barrier layer.

In the above heat-sensitive recording material according to the second embodiment, the heat-sensitive recording material maybe obtained by consecutively forming, on the substrate, an intermediate layer, the first oxygen-barrier layer, the heat-sensitive recording layer and the second oxygen-barrier layer.

In the above heat-sensitive recording material according to the second embodiment, a protective layer may be formed on the second oxygen-barrier layer.

According to the third embodiment, further, there is provided a process for the production of a heat-sensitive recording material in which a heat-sensitive recording layer which thermally forms a color is directly or indirectly formed on a substrate, which process comprises the steps of forming an oxygen-barrier layer formed mainly of a polymer substance on one surface of the substrate to form a laminated sheet having an oxygen permeability of 1,000 cm$^3$/m$^2$·24 hr·atm or less, then forming the heat-sensitive recording layer on the oxygen-barrier layer surface or the other surface of the substrate of the laminated sheet, and further forming other oxygen-barrier layer on the heat-sensitive recording layer surface to sandwich the heat-sensitive recording layer between the two oxygen-barrier layers, the steps being carried out to allow the heat-sensitive recording material to have an oxygen permeability equivalent to, or smaller than, a value obtained by multiplying an oxygen permeability of the laminated sheet by 0.5.

DETAILED DESCRIPTION OF THE INVENTION

The heat-sensitive recording material according to the present invention will be explained in detail hereinafter.

In the first embodiment, the heat-sensitive recording material may have any constitution so long as the heat-sensitive recording layer is present between two oxygen-barrier layers having a basis weight of 2 to 20 g/m$^2$ each. In one case, the substrate may be present between the two oxygen-barrier layers, or in other case, it may be absent between the two oxygen-barrier layers. An intermediate layer may be provided between the substrate and the heat-sensitive recording layer for improving thermal response properties. In this case, the intermediate layer may be present or absent between the two oxygen-barrier layers.

The various novel characteristics of the first embodiment are as disclosed above with regard to its constitutions, while preferred embodiments thereof will be explained with reference to drawings, for better understanding of the functional advantages thereof and specific objects to be achieved by the first embodiment.

Figure 1:
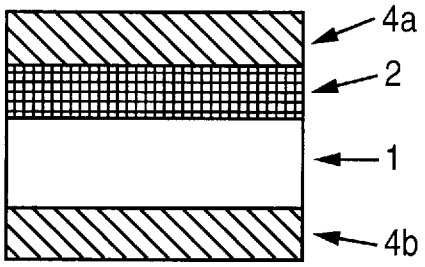
FIG. 1 is a schematic cross-sectional view of a heat-sensitive recording material having a substrate and a heat-sensitive recording layer both of which are formed between two oxygen-barrier layers.

FIG. 1 is a schematic cross-sectional view of a heat-sensitive recording material of the first embodiment in which a substrate 1 and a heat-sensitive recording layer 2 are present between two oxygen-barrier layers 4*a* and 4*b* having abasis weight of 2 to 20 g/m$^2$ each. The heat-sensitive recording material can be obtained, for example, by forming the heat-sensitive recording layer 2 on the substrate 1 to obtain a conventional heat-sensitive recording material, and by consecutively forming the oxygen-barrier layers 4*a* and 4*b* in the order of the heat-sensitive recording layer surface and the substrate surface or in the order of the substrate surface and the heat-sensitive recording layer surface, or by forming one of the oxygen-barrier layers 4*a* and 4*b* on one of the above two surfaces of the general heat-sensitive recording material and the other on the other surface at the same time.

Otherwise, the above heat-sensitive recording material can be obtained by forming the oxygen-barrier layer 4*b* on one surface of the substrate 1 prior to the formation of the heat-sensitive recording layer 2, and then consecutively forming the heat-sensitive recording layer 2 and the oxygen-barrier layer 4*a* on the other surface having no oxygen-barrier layer formed thereon.

Figure 2:
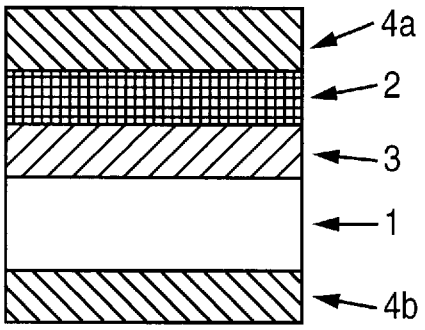
FIG. 2 is a schematic cross-sectional view of a heat-sensitive recording material having a substrate, an intermediate layer and a heat-sensitive recording layer all of which are formed between two oxygen-barrier layers.

FIG. 2 is a schematic cross-sectional view of a heat-sensitive recording material of the first embodiment in which the substrate 1, an intermediate layer 3 and the heat-sensitive recording layer 2 are present between the two oxygen-barrier layers 4*a* and 4*b* having a basis weight of 2 to 20 g/m$^2$ each. The heat-sensitive recording material can be obtained, for example, by consecutively forming the intermediate layer 3 and the heat-sensitive recording layer 2 on the substrate 1 to obtain a conventional heat-sensitive recording material, and by consecutively forming the oxygen-barrier layers 4*a* and 4*b* in the order of the heat-sensitive recording layer surface and the substrate surface or in the order of the substrate surface and the heat-sensitive recording layer surface, or by forming one of the oxygen-barrier layers 4*a* and 4*b* on one of the above two surfaces of the general heat-sensitive recording material and the other on the other surface at the same time.

Otherwise, the above heat-sensitive recording material can be obtained by forming the oxygen-barrier layer 4*b* on one surface of the substrate 1 prior to the formation of the intermediate layer 3 and the heat-sensitive recording layer 2, and then consecutively forming the intermediate layer 3, the heat-sensitive recording layer 2 and the oxygen-barrier layer 4*a* on the other surface having no oxygen-barrier layer formed thereon.

Figure 3:
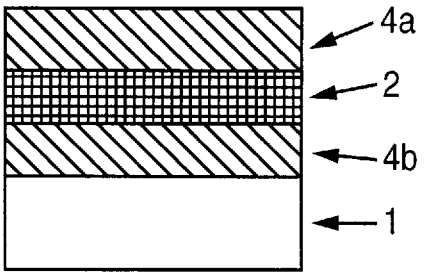
FIG. 3 is a schematic cross-sectional view of a heat-sensitive recording material having a heat-sensitive recording layer formed between two oxygen-barrier layers.

FIG. 3 is a schematic cross-sectional view of a heat-sensitive recording material of the first embodiment in which the heat-sensitive recording layer 2 are present between two oxygen-barrier layers 4*a* and 4*b* having a basis weight of 2 to 20 g/m$^2$ each. The heat-sensitive recording material can be obtained, for example, by consecutively forming the oxygen-barrier layer 4*b* having a basis weight of 2 to 20 g/m$^2$, the heat-sensitive recording layer 2 and the oxygen-barrier layer 4*a* having a basis weight of 2 to 20 g/m$^2$ on one sufface of the substrate 1.

Figure 4:
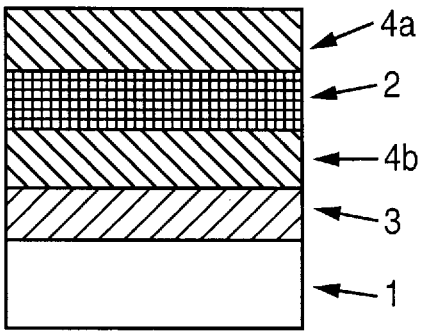
FIG. 4 is a schematic cross-sectional view of a heat-sensitive recording material having a heat-sensitive recording layer formed between two oxygen-barrier layers and further having an intermediate layer between a substrate and the oxygen-barrier layer.

FIG. 4 is a schematic cross-sectional view of a heat-sensitive recording material of the first embodiment in which the heat-sensitive recording layer 2 is present between two oxygen-barrier layers 4*a* and 4*b* having a basis weight of 2 to 20 g/m$^2$ each and further, the intermediate layer 3 is formed between the substrate 1 and the oxygen-barrier layer 4*b*. The heat-sensitive recording material can be obtained, for example, by consecutively forming the intermediate layer 3, the oxygen-barrier layer 4*b* having a basis weight of 2 to 20 g/m$^2$, the heat-sensitive recording layer 2 and the oxygen-barrier layer 4*a* having a basis weight of 2 to 20 g/m$^2$ on one surface of the substrate 1.

Figure 5:
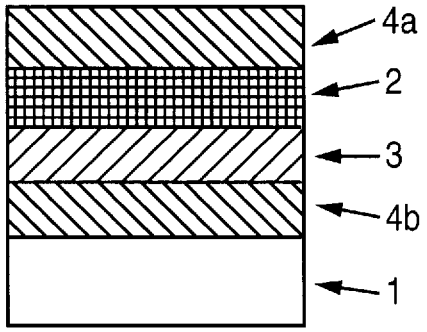
FIG. 5 is a schematic cross-sectional view of a heat-sensitive recording material having an intermediate layer and a heat-sensitive recording layer both of which are formed between two oxygen-barrier layers.

FIG. 5 is a schematic cross-sectional view of a heat-sensitive recording material of the first embodiment, in which the intermediate layer 3 and the heat-sensitive recording layer 2 are present between two oxygen-barrier layers 4*a* and 4*b* having a basis weight of 2 to 20 g/m$^2$. The heat-sensitive recording material can be obtained, for example, by consecutively forming the oxygen-barrier layer 4*b* having a basis weight of 2 to 20 g/m$^2$, the intermediate layer 3, the heat-sensitive recording layer 2 and the oxygen-barrier layer 4*a* having a basis weight of 2 to 20 g/m$^2$ on one surface of the substrate 1. The heat-sensitive recording material in which the heat-sensitive recording layer 2 which thermally forms a color is formed on the substrate 1 exhibits excellent light resistance in a non-printed portion particularly when the heat-sensitive recording layer 2 alone is, or the intermediate layer 3 and the heat-sensitive recording layer 2 are, present between the two oxygen-barrier layers 4*a* and 4*b*.

The heat-sensitive recording material of the first embodiment in which the heat-sensitive recording layer 2 alone is present between the two oxygen-barrier layers 4*a* and 4*b* is as shown in FIG. 3 or 4.

The heat-sensitive recording material of the first embodiment in which the intermediate layer 3 and the heat-sensitive recording layer 2 are present between the two oxygen-barrier layers 4*a* and 4*b* is as shown in FIG. 5.

The oxygen-barrier layers in the heat-sensitive recording material according the first embodiment will be explained hereinafter.

Each of the oxygen-barrier layers has an oxygen permeability constant of $0.5\times10^{-10}$cm$^3$·cm/cm$^2$·sec·cmHg or less and is formed of a polymer substance.

When the oxygen permeability constant values are described in literature, etc., those values may be used for selecting the polymer substance used for forming the oxygen-barrier layers. The oxygen permeability constants of some films may be influenced by ambient temperature and humidity, while the polymer substance may be selected from those having an oxygen permeability constant of $0.5\times10^{-10}$cm$^3$·cm/cm$^2$·sec·cmHg or less in at least one point in the range of 20° to 30° C. in temperature and 40 to 70% RH in humidity which range is an average indoor environment.

Examples of the polymer substance having an oxygen permeability constant of $0.5\times10^{-10}$cm$^3$·cm/cm$^2$·sec·cmHg or less, which can be used for the oxygen-barrier layer, include polyvinyl alcohol, polyvinylidene chloride, polyacrylonitrile, nylon 6, cellulose acetate, polyvinyl chloride, polyvinyl acetate, an ethylene-vinyl alcohol copolymer, high-density polyethylene, an acrylonitrile-methyl acrylate-butadiene copolymer, an acrylonitrile-styrene copolymer, polymethacrylonitrile, a methacrylonitrile-styrene copolymer, a methacrylonitrile-styrene-butadiene copolymer, polytrifluorochloroethylene and Cellophane.

The heat-sensitive recording material of the first embodiment exhibits sufficient light resistance in a non-printed portion only when the heat-sensitive recording layer is present between the oxygen-barrier layers having a basis weight of 2 to 20 g/m$^2$ each. When one oxygen-barrier layer having a basis weight of 2 to 20 g/m$^2$ is formed only on one surface of the heat-sensitive recording layer, there can be obtained no sufficient light resistance in a non-printed portion. For example, when the oxygen-barrier layer is formed only between the substrate and the heat-sensitive recording layer, or when the oxygen-barrier layer is formed only on the heat-sensitive recording layer, there can be obtained no sufficient light resistance in a non-printed portion.

As a polymer substance having an oxygen permeability constant of $0.5\times10^{-10}$cm$^3$·cm/cm$^2$·sec·cmHg or less for forming the oxygen-barrier layer of the heat-sensitive recording material, for example, polyvinyl alcohol can be used. It has been already known to use polyvinyl alcohol for forming a protective layer of a heat-sensitive recording material. Japanese Utility Model Laid-open Publication No. 56-125354, JP-A-57-69091, JP-A-58-188689 and JP-A-58-208091 disclose methods in which a polyvinyl alcohol layer is formed on a heat-sensitive recording layer to obtain a heat-sensitive recording material improved in chemical resistance. However, these methods seek to prevent the infiltration of cosmetics, oils, etc., into the heat-sensitive recording layer from a printed surface of the heat-sensitive recording material by forming the polyvinyl alcohol layer as a protective layer.

The inventions of the above publications are therefore clearly distinguishable from the present invention which seeks to insulate the heat-sensitive recording layer against ambient atmosphere by forming the two oxygen-barrier layers for the heat-sensitive recording layer, one on the printed surface side and the other on the substrate surface side.

The oxygen-barrier layers are required to have a basis weight of at least 2 g/m$^2$ each. When the basis weight is less than 2 g/m$^2$, no sufficient light resistance can be performed.

Further, the oxygen-barrier layers preferably have a basis weight of at least 20 g/m$^2$ or less each. When the basis weight exceeds 20 g/m$^2$, the thermal response property of the heat-sensitive recording material may be impaired.

Each oxygen-barrier layer is formed of a polymer substance having an oxygen permeability constant of $0.5\times10^{31}$ $_{10}$cm$^3$·cm/cm$^2$·sec·cmHg or less. When the polymer substance can be prepared in the form of an aqueous emulsion, a solution in an organic solvent or an aqueous solution, it can be formed by an application method, or the like.

Further, each oxygen-barrier layer can be also formed by applying a monomer mixture or an oligomer which can generate a polymer substance, and polymerizing it under ultraviolet light or electron beam.

When the polymer substance is available in the form of a film, the polymer substance in the form of a film can be used. For example, the film may be attached with a proper adhesive to use it as an oxygen-barrier layer.

Each oxygen-barrier layer of the heat-sensitive recording material may be formed of a plurality of layers. For example, two kinds of polymer substances each of which has an oxygen permeability constant of less than $0.5\times10^{-10}$cm$^3$·cm/cm$^2$·sec·cmHg may be laminated to form an oxygen-barrier layer having higher oxygen-insulating capability.

In the first embodiment, each of the oxygen-barrier layers may contain a crosslinking agent in an amount up to 10% by weight based on the weight of the oxygen-barrier layer. The crosslinking agent includes boric acid, zirconium ammon carbonate, glyoxal, an epoxy-containing crosslinking agent, a melamine-formalin precondensate and a urea-formalin precondensate. The incorporation of the crosslinking agent improves the water resistance of the heat-sensitive recording material.

Each of the oxygen-barrier layers may contain a generally used ultraviolet absorbent in an amount up to 10% by weight based on the weight of the oxygen-barrier layer, for further improving the light resistance. For example, the ultraviolet absorbent can be selected from a benzotriazole-ultraviolet absorbent, a benzophenone-ultraviolet absorbent, a phenyl salicylate ester-ultraviolet absorbent, titanium oxide and zinc oxide.

Further, each of the oxygen-barrier layers may contain a generally used organic or inorganic pigment or lubricant in an amount up to 10% by weight based on the weight of the oxygen-barrier layer, for improving the running properties of the heat-sensitive recording material. For example, the organic or inorganic pigment or lubricant can be selected from inorganic pigments such as calcined kaolin, kaolin, talc, calcium carbonate, zinc oxide, diatomaceous earth, aluminum hydroxide, magnesium hydroxide and silica, and organic pigments and organic microsphere pigments such as a styrene-acrylic resin, a polystyrene resin, an acrylic resin, a polyethylene resin, a polypropylene resin and a urea-formaldehyde resin.

Further, each of the oxygen-barrier layers may contain generally used surfactant and defoamer in an amount up to 10% by weight based on the weight of the oxygen-barrier layer, for improving the operability or workability.

When each of the oxygen-barrier layers of the heat-sensitive recording material contains the crosslinking agent, the ultraviolet absorbent, the pigment, the lubricant, the surfactant and the defoamer, the ratio of the polymer substance having an oxygen permeability constant of $0.5\times10^{-10}$ $cm^3\cdot cm/cm^2\cdot sec\cdot cmHg$ or less is required to be at least 80% by weight based on the weight of oxygen-barrier layer.

The heat-sensitive recording material according to the second embodiment will be explained in detail hereinafter.

The heat-sensitive recording material according to the second embodiment comprises a heat-sensitive recording layer which thermally forms a color and is directly or indirectly formed on a substrate, which heat-sensitive recording material is obtained by forming an oxygen-barrier layer formed mainly of a polymer substance on one surface of the substrate to form a laminated sheet having an oxygen permeability of 1,000 $cm^3/m^2\cdot 24$ hr·atm or less, then forming the heat-sensitive recording layer on the oxygen-barrier layer surface or the other surface of the substrate of the laminated sheet, and further forming other oxygen-barrier layer on the heat-sensitive recording layer surface to sandwich the heat-sensitive recording layer between the two oxygen-barrier layers, the heat-sensitive recording material having an oxygen permeability equivalent to, or smaller than, a value obtained by multiplying an oxygen permeability of the laminated sheet by 0.5.

Like the heat-sensitive recording material according to the first embodiment, the heat-sensitive recording material according to the present invention 2 may have any constitution so long as the heat-sensitive recording layer is present between two oxygen-barrier layers. In one case, the substrate may be present between the two oxygen-barrier layers, or in other case, it may be absent between the two oxygen-barrier layers. An intermediate layer may be provided between the substrate and the heat-sensitive recording layer for improving thermal response properties. In this case, the intermediate layer may be present or absent between the two oxygen-barrier layers.

The heat-sensitive recording material according to the second embodiment includes those heat-sensitive recording materials which are already discussed with reference to FIGS. 1 to 5, and the heat-sensitive recording material shown in FIG. 3 or 4 is preferred.

Figure 6:
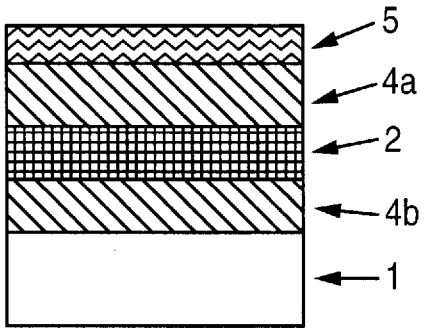
FIG. 6 is a schematic cross-sectional view of a heat-sensitive recording material having and a heat-sensitive recording layer formed between two oxygen-barrier layers and having a protective layer formed on the oxygen-barrier layer which is located outermost.
Figure 7:
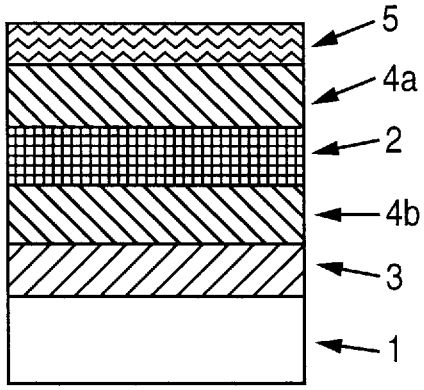
FIG. 7 is a schematic cross-sectional view of a heat-sensitive recording material having a heat-sensitive recording layer formed between two oxygen-barrier layers, having an intermediate layer formed between a substrate and the oxygen-barrier layer and further having a protective layer formed on the oxygen-barrier layer which is located outermost.

Further, preferred is a heat-sensitive recording material obtained by forming a protective layer on the outermost oxygen-barrier layer of the heat-sensitive recording material of which the cross section is schematically shown in FIG. 3 or 4. FIG. 6 or 7 shows a schematic cross-sectional view of the heat-sensitive recording material obtained by providing the heat-sensitive recording material shown in FIG. 3 or 4 with a protective layer.

In the heat-sensitive recording material according to the second embodiment, the oxygen permeability of the laminated sheet is defined to be in a specific range. Generally, the heat-sensitive recording material uses, as a substrate, a material having an oxygen permeability of at least 3,000 $cm^3/m^2\cdot 24$ hr·atm such as paper, nonwoven fabric or a synthetic fiber, and the heat-sensitive recording layer is formed on the substrate. For obtaining the heat-sensitive recording material according to the second embodiment, the laminated sheet having the first oxygen-barrier layer is first prepared such that the laminated sheet has an oxygen permeability of 1,000 $cm^3/m^2\cdot 24$ hr·atm or less.

Then, the heat-sensitive recording layer is formed. The heat-sensitive recording layer may be formed on any one of the two surfaces of the laminated sheet. The heat-sensitive recording layer can be obtained by applying a solid dye precursor and fine particles of an inorganic or organic color developer together with a binder, while the capability of the heat-sensitive recording layer decreasing the oxygen permeability is very low, presumably because the heat-sensitive recording layer contains many pinholes.

For obtaining the heat-sensitive recording material according to the second embodiment, further, it is required to form the second oxygen-barrier layer such that the oxygen permeability of the heat-sensitive recording material is equivalent to, or smaller than, the value obtained by multiplying the oxygen permeability of the laminated sheet by 0.5. When the second oxygen-barrier layer is formed, it is required to form the second oxygen-barrier layer such that the heat-sensitive recording layer is present between the first and second oxygen-barrier layers.

The material for the oxygen-barrier layers of the heat-sensitive recording material of the second embodiment can be selected from any materials so long as it satisfies the oxygen permeability of each of the laminated sheet and the heat-sensitive recording material. Each oxygen-barrier layer can be formed by applying the material once or a plurality of times. Further, each oxygen-barrier layer may be a set of a plurality of layers.

As an intermediate layer in the heat-sensitive recording material according to the second embodiment, the intermediate layer used in the first embodiment can apply. The material for the intermediate layer will be specifically discussed later.

The material for forming the oxygen-barrier layers of the heat-sensitive recording material according to the second embodiment can be any material so long as it is a film-forming polymer substance, and it can be selected from known hydrophobic polymer emulsions and water-soluble polymers.

Examples of the above material include a styrene-butadiene latex copolymer, an acrylonitrile-butadiene-styrene copolymer, a vinyl acetate resin, a vinyl acetate-acrylate ester copolymer, a styrene-acrylate ester copolymer, an acrylic acid ester resin, apolyurethane resin, polyvinyl alcohol, starch or its derivative, cellulose derivatives such as hydroxyethyl cellulose, carboxylmethyl cellulose, methyl cellulose, cellulose acetate and ethyl cellulose, sodium polyacrylate, polyvinyl pyrrolidone, an acrylamide-acrylate ester copolymer, an acrylamide-acrylate ester-methacrylic acid copolymer, a styrene-maleic anhydride copolymer alkali salt, polyacrylamide, sodium alginate, gelatin, casein, polyvinylidene chloride, polyacrylonitrile, nylon 6, polyvinyl chloride, an ethylene-vinyl alcohol copolymer, high-density polyethylene, an acrylonitrile-methyl acrylate-butadiene copolymer, an acrylonitrile-styrene copolymer, polymethacrylonitrile, a methacrylonitrile-styrene copolymer, a methacrylonitrile-styrene-butadiene copolymer, polytrifluorochloroethylene and Cellophane.

Like the first embodiment, the oxygen-barrier layers of the heat-sensitive recording material according to the second embodiment can be formed by a method in which an aqueous solution of the polymer substance, an aqueous emulsion of the polymer substance, a solution of the polymer substance in an organic solvent or an aqueous solution of the polymer substance in an organic solvent is applied, a method in which a monomer mixture or an oligomer which generates the above polymer substance is applied and then polymerzed with ultraviolet light or electron beam, or a method in which a film of the above polymer substance is attached.

Further, like the first embodiment, the oxygen-barrier layers can contain an organic pigment, an inorganic pigment, a crosslinking agent, an ultraviolet absorbent, alubricant, asurfactantandanantifoamer. When these are contained, the content thereof in each oxygen-barrier layer is not specially limited, while it is required to incorporate them in a specific amount range in which the oxygen permeability is maintained.

The process for the production of a heat-sensitive recording material, according to the third embodiment, is directed to a process for the production of a heat-sensitive recording material in which a heat-sensitive recording layer which thermally forms a color is directly or indirectly formed on a substrate, which process comprises the steps of forming an oxygen-barrier layer formed mainly of a polymer substance on one surface of the substrate to form a laminated sheet having an oxygen permeability of 1,000 $cm^3/m^2 \cdot 24$ hr·atm or less, then forming the heat-sensitive recording layer on the oxygen-barrier layer surface or the other surface of the substrate of the laminated sheet, and further forming other oxygen-barrier layer on the heat-sensitive recording layer surface to sandwich the heat-sensitive recording layer between the two oxygen-barrier layers, the steps being carried out to allow the heat-sensitive recording material to have an oxygen permeability equivalent to, or smaller than, a value obtained by multiplying an oxygen permeability of the laminated sheet by 0.5.

In the above process for the production of a heat-sensitive recording material, the laminated sheet obtained by forming the oxygen-barrier layer preferably has an oxygen permeability of 500 $cm^3/m^2 \cdot 24$ hr·atm or less.

Those points which are common to the first and second embodiments will be explained hereinafter.

In the heat-sensitive recording material of the present invention, the characteristic "oxygen permeability constant" and "oxygen permeability" will be first explained below.

The oxygen permeability constant and the oxygen permeability can be measured by a method according to JIS K7126(1987).

The oxygen permeability refers to a unit partial pressure differential and is a volume of oxygen which passes a test piece having a unit area for a unit time.

When a test piece partitions a space to two portions and when the concentration of oxygen is different between the two portions, gas is diffused from a high-concentration side to a low-concentration side through a membrane. When a constant difference in oxygen pressure is there between two spaces partitioned by a membrane having a constant area, the oxygen permeability can be calculated by measuring the amount of oxygen which has passed through the membrane for a constant period of time. The oxygen permeability measurement can be carried out with regard to a variety of films, composite materials, laminated materials and processed paper, and the laminated sheet and the heat-sensitive recording material in the present invention can be measured for oxygen permeability by a method according to JIS K7126 (1987).

On the other hand, theoretically, the oxygen permeability constant is a value obtained by multiplying an oxygen permeability by the thickness of a test piece and converting a product to a permeation amount per a unit thickness.

The oxygen permeability constant is helpful for comparing polymer substances forming membranes, and it is a value which has nothing to do with the thickness of a film and is characteristic of a polymer substance. The oxygen permeability constant shows that the greater the value is, greater the permeability to gas is.

When the polymer substance is supplied in the form of a film, the polymer substance itself can be measured for determining the oxygen permeability constant. When the polymer substance is not supplied in the form of a film, it is formed into a film by a solution method, a calender method, a T-die method or an inflation method and the film can be measured.

The oxygen permeability and the oxygen permeability constant can be obtained by any measurement method so long as the method is according to JIS K7126 (1987). As a specific example of the measurement method, there is a pressure method in which an oxygen having a constant pressure is charged onto one surface of a sample film, and an increase in pressure on the other surface is detected with the passage of time for the measurement. The increase in pressure is measurable with various vacuum gages and pressure gages such as a mercury manometer, a Macleod gage, a straingage differential pressure gage and a Pirani gage.

An equal pressure method is another specific example. In the equal pressure method, the pressure on one surface of a sample film and the pressure on the other surface are set to be equal, the partial pressures of oxygen alone on the two surfaces differ, and the oxygen concentration is measured for a change.

The light resistance of the heat-sensitive recording material will be explained hereinafter.

The heat-sensitive recording materials according to the first and second embodiments are excellent in light resistance in a non-printed portion as compared with general heat-sensitive recording materials, and they are excellent particularly in light resistance against light from a fluorescent lamp and light coming into a room through awindow. Specifically, they have sufficient light resistance in an environment where they are exposed to 300 to 1,500 lux visible light.

When a conventional heat-sensitive recording material is kept indoors where it is exposed to light, i.e., kept affixed to a wall or tagged in a store, its non-printed portion gradually undergoes discoloration with the passage of time and the discoloration proceeds so that the non-printed portion visually turns clearly yellowish in a few months.

On the other hand, when the heat-sensitive recording material of the present invention is kept exposed to light indoors, the discoloration of its non-printed portion is remarkably low as compared with any conventional heat-sensitive recording material, and even when it is kept for about 2 months, it does not visually turn yellowish.

One possible reason why the heat-sensitive recording material of the present invention has excellent light resistance in a non-printed portion will be explained below. In the beginning of the present invention, the present inventor tested conventional heat-sensitive recording materials for light resistance. That is, the conventional heat-sensitive recording materials were placed in sealable containers, and the atmosphere in the first container was purged with oxygen, the atmosphere in the second container was purged with nitrogen, and the atmosphere in the third container was maintained without any purging. The test gave the results that the material in the container containing nitrogen underwent less discoloration in a non-printed portion than the material in the container containing the atmosphere without any purging, and that the material in the container containing oxygen underwent much greater discoloration in a non-printed portion than the material in the container containing the atmosphere without any purging. The above results are presumably brought because the rate of photo-oxidation of a colorless or light-color basic leuco dye, which causes the discoloration of a non-printed portion, is influenced by the amount of oxygen in the container.

On the other hand, when the heat-sensitive recording layer is isolated from atmosphere by two oxygen-barrier layers, presumably, the amount of oxygen to which the colorless or pale colored leuco dye is kept exposed for a certain period of time is small, which gives excellent light resistance in a non-printed portion.

When the production of the heat-sensitive recording material of the present invention is completed, oxygen is considered to be present between the two oxygen-barrier layers to some extent. However, it is considered that the two oxygen-barrier layers prevent oxygen from newly coming into the heat-sensitive recording layer, and as a consequence, the photo-oxidation rate of the colorless or pale colored basic leuco dye is decreased. When observed for a long period of time, the heat-sensitive recording material of the present invention is remarkably excellent in light resistance in a non-printed portion over conventional heat-sensitive recording materials having no oxygen-barrier layer in which the heat-sensitive recording layer is in constant contact with fresh oxygen in atmosphere.

The heat-sensitive recording material of the present invention can be improved in running properties by forming the oxygen-barrier layer on the heat-sensitive recording layer and further forming thereon a protective layer containing an inorganic pigment, an organic pigment, a lubricant, etc. In this case, the amount of the protective layer is preferably 0.5 to 3 g/m$^2$.

In the heat-sensitive recording material of the present invention, an intermediate layer may be formed between the substrate and the heat-sensitive recording layer, between the substrate and the oxygen-barrier layer or between the oxygen-barrier layer contacting the substrate and the heat-sensitive recording layer, for improving thermal response properties. When the heat-sensitive recording material of the present invention has the intermediate layer, the amount of the intermediate layer is preferably 1 to 30 g/m$^2$, more preferably 3 to 20 g/m$^2$.

As a pigment for the intermediate layer, calcined kaolin is generally used, while the pigment for the intermediate layer can be also selected from kaolin, talc, calcium carbonate, zinc oxide, diatomaceous earth, aluminum hydroxide, magnesium hydroxide and silica.

Further, the above pigment can be also selected from organic microsphere pigments such as a styrene-acrylic resin, a polystyrene resin, an acrylic resin, a polyethylene resin, a polypropylene resin and a urea-formaldehyde resin.

The binder for the intermediate layer can be selected from known hydrophobic polymer emulsions or water-soluble polymers.

Examples of the hydrophobic polymer emulsions include styrene-butadiene latex, acrylonitrile-butadiene latex, a vinyl acetate resin, a vinyl acetate-acrylate ester copolymer, a styrene-acrylate ester copolymer, an acrylic acid ester resin and a polyurethane resin.

Examples of the water-soluble polymers include polyvinyl alcohol, starch or its derivative, cellulose derivatives such as hyroxyethyl cellulose, carboxymethyl cellulose, methyl cellulose and ethyl cellulose, sodium polyacrylate, polyvinyl pyrrolidone, an acrylamide-acrylate ester copolymer, an acrylamide-acrylate ester-methacrylic acid copolymer, a styrene-maleic anhydride copolymer alkali salt, polyacrylamide, sodium alginate, gelatin and casein.

As a substrate for the heat-sensitive recording material, paper is generally used. Besides paper, the substrate can be selected from various woven fabrics, non-woven fabrics, a synthetic resin film, laminated paper, synthetic paper, a metal foil and composite sheets obtained by combining these, as required depending upon a purpose. When the substrate of the heat-sensitive recording material of the present invention is a substrate having higher gas permeability such as paper or one of various woven fabrics and non-woven fabrics, the formation of the oxygen-barrier layers according to the present invention has a higher effect on the improvement of light resistance.

In the heat-sensitive recording material of the present invention, the heat-sensitive recording layer can be formed, for example, by mixing an aqueous dispersion obtained by finely milling a color-forming component with a binder, applying the mixture and drying the applied mixture. The heat-sensitive recording layer may have a layer constitution of a single layer or multi-layers. For the heat-sensitive recording layer of the heat-sensitive recording material of the present invention, there may be used a color-forming component composed of a basic leuco dye and an acidic phenolic compound, which is used in general heat-sensitive recording materials.

The basic leuco dye used in the heat-sensitive recording layer is not specially limited so long as it is generally used for pressure-sensitive recording paper and heat-sensitive recording materials.

Specific examples of the basic leuco dye include Crystal Violet Lactone, 3-(p-dimethylaminophenyl)-3-(1,2-dimethylindol-3-yl)phthalide, 3,3-bis(2-methyl-1-octyl-3-indolyl)phthalide, 3-[4-diethylamino-2-ethoxyphenyl]-3-(2-methyl-1-octyl-3-indolyl)-4-azaphthalide, 3,3-bis(2-methyl-1-octyl-3-indolyl)-4-azaphthalide, 3-cyclohexylamino-6-chlorofluoran, 3-diethylamino-7-chlorofluoran, 3-diethylamino-5-methyl-7-dibenzylaminofluoran, 3-diethylamino-6-methyl-7-anilinofluoran, 3-(N-ethyl-N-isopentylamino)-6-methyl-7-anilinofluoran, 3-(N-methyl-N-cyclohexylamino)-6-methyl-7-anilinofluoran, 3-piperidino-6-amino-7-anilinofluoran, 3-dibutylamino-6-methyl-7-anilinofluoran, 3-diethylamino-7-(2-chloroanilino)fluoran, 3-diethylamino-7-[(3-trifluoromethylphenyl)amino]fluoran, 3-[ethyl(3-methylbutyl)amino]-7-[(2-chlorophenyl)amino]fluoran, 3-[ethyl(4-methylphenyl)amino]-6-methyl-7-anilinofluoran, and 6'-dibutylamino-2'-(2-fluoroanilino)spiro[phthalide-3, 9'-xanthene].

The acidic phenolic compound is not specially limited so long as it is generally used for heat-sensitive recording materials.

Specific examples of the acidic phenolic compound include 2,2-bis(p-hydroxyphenyl)propane, 1,1-bis(p-hydroxyphenyl) cyclohexane, 2,2-bis (p-hydroxyphenyl) hexane, 4-hydroxy-4'-isopropoxydiphenylsulfone, 4,4'-dihydroxydiphenylsulfone, 2,4'-dihydroxydiphenylsulfone, 3,3'-diallyl-4,4'-dihydroxydiphenylsulfone, 4,4'-dihydroxydiphenyl ether, butyl 2,2-bis(4-hydroxyphenyl) acetate, methyl 2,2-bis(4-hydroxypheny)acetate, 4,4'-thiobis (2-tert-butyl-5-methylphenol), benzyl p-hydroxybenzoate, stearyl gallate, 3,5-di-tert-butylsalicylic acid, zinc 3,5-di-tert-butylsalicylate, zinc 4-[2'-(4-methoxyphenoxy) ethyloxy]salicylate, zinc 4-n-heptyloxycarbonylaminosalicylate, zinc 4-n-octyloxycarbonylaminosalicylate, zinc 4-n-nonyloxycarbonylaminosalicylate, and 4-n-decyloxycarbonylaminosalicylate.

For the heat-sensitive recording layer of the heat-sensitive recording material of the present invention, as disclosed in JP-A-58-38733, JP-A-58-54085, JP-A-58-104959, JP-A-59-115887 and JP-A-60-262686, there can be used a color-forming component composed of an aromatic isocyanate compound and an aromatic imino compound which forms color by reacting with the isocyanate compound when heated.

The aromatic isocyanate compound used for the heat-sensitive recording layer is a colorless or pale colored compound which is a solid at room temperature. Examples of the aromatic isocyanate compound include 1,3-phenylene diisocyanate, 1,3-dimethylbenzene-4,6-diisocyanate, 1-ethoxybenzene-2,4-diisocyanate, 2,5-diethoxybenzene-1, 4-diisocyanate, diphenyl ether-4,4'-diisocyanate, naphthalene-1,4-diisocyanate, 3,3'-dimethylbiphenyl-4,4'-diisocyanate, dipehenylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4"-triisocyanate-triphenylamine, and 4,4',4"-triisocyanate-2,5-dimethoxytriphenylamine. The above isocyanate compounds are used alone or in combination.

The above aromatic isocyanate compound may be used in the form of an adduct with a phenol, a lactam or an oxime, i.e., a so-called blocked isocyanate, as required. For example, it may be used in the form of a dimer of diisocyanate such as 1-methylbenzene-2,4-diisocyanate or a trimer such as iscyanurate. Further, it may be used in the form of a polyisocyanate which is an adduct obtained in the presence of a polyol.

The aromatic imino compound used for the heat-sensitive recording layer is a colorless or pale colored compound which is a solid at room temperature. Specific examples thereof include 3-imino-4,5,6-tetrachloroisoindolin-1-one, 1,3-diimino-4,5,6,7-tetrachloroisoindoline, 1,3-diiminoisoindoline, 1,3-diiminobenz(f)isoindoline, 1,3-diiminonaphth(2,3-f)isoindoline, 1,3-diimino-5-nitroisoindoline, 1,3-diimino-5-phenylisoindoline, 1,3-diimino-5-methoxyisoindoline, 1,3-diimino-5-chloroisoindoline, 5-cyano-1,3-diiminoisoindoline, 1,3-diimino-4,7-dimethoxyisoindoline, 4,7-diethoxy-1,3-diiminoisoindoline, 4,5,6,7-tetrabromo-1,3-diiminoisoindoline, 4,5,6,7-tetrafluoro-1,3-diiminoisoindoline, 4,5,7-trichloro-1,3-diimino-6-methylmercaptoisoindoline, and 4,5,6,7-tetrachloroisoindolin-1-one.

In the heat-sensitive recording material of the present invention, the heat-sensitive recording layer may contain a heat-fusible substance for improving thermal response properties. In this case, a substance having a melting point of 60° to 180° C. is preferred, and in particular, a substance having a melting point of 80° to 140° C. is more preferred.

Specific examples of the above heat-fusible substance include N-hydroxymethylstearic acid amide, stearic acid amide, palmitic acid amide, oleic acid amide, ethylenebisstearic acid amide, methylenebis hydrogenated beef tallow fatty acid amide, ricinoleic acid amide, waxes such as paraffin wax, microcrystalline wax, polyethylene wax and carnauba wax, naphthol derivatives such as 2-benzyloxynaphthalene, biphenyl derivatives such as p-benzylbiphenyl and 4-allyloxybiphenyl, polyether compounds such as 1,2-bis(3-methylphenoxy)ethane, 2,2'-bis(4-methoxyphenoxy) diethyl ether, bis (4-methoxyphenoxy) ether, α, α'-diphenoxy-o-xylene and α, α'-diphenoxy-p-xylene, and ester derivatives such as diphenyl carbonate, dibenzyl oxalate and di(p-methylbenzyl) oxlate.

The above heat-fusible substances may be used alone or in combination. For attaining sufficient thermal response properties, the content of the heat-fusible substance based on the total solid content of the heat-sensitive recording layer is preferably 5 to 50% by weight.

The binder used in the heat-sensitive recording layer can be selected from various binders used for general applications. Examples of the binder include water-soluble binders such as starches, hydroxymethyl cellulose, carboxymethyl cellulose, gelatin, casein, polyvinyl alcohol, modified polyvinyl alcohol, an acrylamide-acrylate ester copolymer, an acrylamide-acrylate ester-methacrylic acid copolymer, an alkali salt of a styrene-maleic anhydride copolymer and an alkali salt of an isobutylene-maleic anhydride, and emulsion type aqueous binders such as a styrene-butadiene copolymer, an acrylonitrile-butadiene copolymer and a methyl acrylate-butadiene copolymer.

Further, the heat-sensitive recording layer may contain a pigment such as diatomaceous earth, talc, kaolin, calcined kaolin, calcium carbonate, magnesium carbonate, titanium oxide, silicon oxide, aluminum hydroxide, zinc oxide, a urea-formaldehyde resin or organic microsphere particles, a lubricant such as zinc stearate, calcium stearate, paraffin, polyethylene oxide, stearic acid amide or castor wax, a dispersing and wetting agent such as an anionic or nonionic surfactant including a surfactant having ahighmolecular weight, a fluorescent dye and an anti-foamer, as required.

In the heat-sensitive recording material of the present invention, the heat-sensitive recording layer may contain a generally used ultraviolet absorbent for further improving the light resistance. For example, the ultraviolet absorbent is selected from a benzotriazole-containing ultraviolet absorbent, a benzophenone-containing ultraviolet absorbent, a phenyl salicylate ester-containing ultraviolet absorbent, titanium oxide or zinc oxide.

EXAMPLES

The present invention will be explained further in detail with reference to Examples hereinafter, while the present invention shall not be limited to Examples. In Examples, "%" stands for "% by weight". Further, when a predetermined application amount was not satisfied by carrying out application once in the formation of oxygen-barrier layers, the application was carried out a plurality of times.

<Heat-sensitive recording material according to the first embodiment>

[Preparation of coating liquid for heat-sensitive recording layer]

Dispersions A, B, C and D were prepared by the following method.

(Dispersion A)

200 Grams of 3-dibutylamino-6-methyl-7-anilinofluoran was dispersed in a mixture containing 200 g of a 10% polyvinyl alcohol aqueous solution and 600 g of water, and the dispersion was milled with a bead mill until an average particle diameter of 1 $\mu$m was attained.

(Dispersion B)

400 Grams of 2,2-bis(p-hydroxyphenyl)propane was dispersed in a mixture containing 400 g of a 10% polyvinyl alcohol aqueous solution and 200 g of water, and the dispersion was milled with a bead mill until an average particle diameter of 1 $\mu$m was attained.

(Dispersion C)

400 Grams of 2-benzyloxynaphthalene was dispersed in a mixture containing 400 g of a 10% polyvinyl alcohol aqueous solution and 200 g of water, and the dispersion was milled with a bead mill until an average particle diameter of 1 $\mu$m was attained.

(Dispersion D)

200 Grams of calcium carbonate was dispersed in 800 g of a 0.5% sodium polyacrylate aqueous solution, and the dispersion was stirred with a homomixer for 10 minutes.

The above dispersions A to D and the following materials were mixed in the following mixing ratio and fully stirred to give a coating liquid for a heat-sensitive recording layer.

| | |
|---|---|
| Dispersion A | 20 parts |
| Dispersion B | 15 parts |
| Dispersion C | 15 parts |
| Dispersion D | 25 parts |
| 10% Polyvinyl alcohol aqueous solution | 30 parts |
| Water | 30 parts |

[Preparation of coating liquid for intermediate layer]

| | |
|---|---|
| 40% Calcined kaolin dispersion | 25 parts |
| 40% Styrene-butadiene latex | 5 parts |
| 10% Phosphate esterified starch aqueous solution | 10 parts |
| Water | 25 parts |

Example 1

A heat-sensitive recording material as shown in FIG. 1 was prepared in the following manner. A 5% polyvinyl alcohol (oxygen permeability constant $0.9\times10^{-12}$cm$^3$·cm/cm$^2$·sec·cmHg) aqueous solution was applied to a base paper sheet 1 having a basis weight of 40 g/m$^2$ with a wire bar so as to form a coating having a dryweight of 2.0 g/m$^2$, and dried. Thus, an oxygen-barrier layer 4*b* was formed on the base paper 1.

Then, the above coating liquid for a heat-sensitive recording layer was applied to the surface not coated with the polyvinyl alcohol, so as to form a coating having a dry weight of 3.0 g/m$^2$, and dried, whereby the heat-sensitive recording layer 2 was formed. Further, a 5% polyvinyl alcohol (oxygen permeability constant $0.9\times10^{-12}$cm$^3$·cm/cm$^2$·sec·cmHg) aqueous solution was applied with a wire bar so as to form a coating having a dry weight of 2.0 g/m$^2$, and dried, whereby another oxygen-barrier layer 4*a* was formed. The resultant coating was treated with a super calender, to give the heat-sensitive recording material as shown in FIG. 1.

Example 2

A heat-sensitive recording material as shown in FIG. 1 was obtained in the same manner as in Example 1 except that the 5% polyvinyl alcohol (oxygen permeability constant $0.9\times10^{-12}$cm$^3$·cm/cm$^2$·sec·cmHg) aqueous solution was replaced with a 40% polyvinylidene chloride (oxygen permeability constant $0.5\times10^{-12}$cm$^3$·cm/cm$^2$·sec·cmHg) aqueous emulsion.

Example 3

A heat-sensitive recording material as shown in FIG. 2 was prepared in the following manners. A 5% polyvinyl alcohol (oxygen permeability constant $0.9\times10^{-12}$cm$^3$·cm/cm$^2$·sec·cmHg) aqueous solution was applied to a base paper sheet 1 having a basis weight of 40 g/m$^2$ with a wire bar so as to form a coating having a dry weight of 2.0 g/m$^2$, and dried, whereby an oxygen-barrier layer 4*b* was formed on the base paper 1.

Then, the above coating liquid for an intermediate layer was applied to the surface not coated with the polyvinyl alcohol with a wire bar, so as to form a coating having a dry weight of 5.0 g/m$^2$, and dried, whereby the intermediate layer 3 was formed. The above coating liquid for a heat-sensitive recording layer was applied so as to form a coating having a dry weight of 3.0 g/m$^2$, and dried, whereby the heat-sensitive recording later 2 was formed on the intermediate layer 3. Further, a 5% polyvinyl alcohol (oxygen permeability constant $0.9\times10^{-12}$cm$^3$·cm/cm$^2$·sec·cmHg) aqueous solution was applied with a wire bar so as to form a coating having a dry weight of 2.0 g/m$^2$, and dried, whereby another oxygen-barrier layer 4*a* was formed on the heat-sensitive recording layer 2. The resultant coating was treated with a super calender, to give the heat-sensitive recording material as shown in FIG. 2.

Example 4

A heat-sensitive recording material as shown in FIG. 3 was prepared in the following manner. A 5% polyvinyl alcohol (oxygen permeability constant $0.9\times10^{-12}$cm$^3$·cm/cm$^2$·sec·cmHg) aqueous solution was applied to a base paper sheet 1 having a basis weight of 40 g/m$^2$ with a wire bar so as to form a coating having a dryweight of 2.0 g/m$^2$, and dried, whereby an oxygen-barrier layer 4*b* was formed on the base paper 1. Further, the above coating liquid for a heat-sensitive recording layer was applied to the same surface so as to form a coating having a dry weight of 3.0 g/m$^2$, and dried, whereby the heat-sensitive recording layer 2 was formed on the oxygen-barrier layer 4*b*. A 5% polyvinyl alcohol (oxygen permeability constant $0.9\times10^{-12}$cm$^3$·cm/cm$^2$·sec·cmHg) aqueous solution was applied with a wire bar so as to form a coating having a dryweight of 2.0 g/m$^2$, and dried, whereby another oxygen-barrier layer 4*a* was formed on the heat-sensitive recording layer 2. The resultant coating was treated with a super calender to give the heat-sensitive recording material as shown in FIG. 3.

Example 5

A heat-sensitive recording material as shown in FIG. 3 was obtained in the same manner as in Example 4 except that the 5% polyvinyl alcohol (oxygen permeability constant $0.9\times10^{-12}cm^3\cdot cm/cm^2\cdot sec\cdot cmHg$) aqueous solution was replaced with a 40% polyvinylidene chloride (oxygen permeability constant $0.5\times10^{-12}cm^3\cdot cm/cm^2\cdot sec\cdot cmHg$ or less) aqueous emulsion.

Example 6

A heat-sensitive recording material as shown in FIG. 3 was obtained in the same manner as in Example 4 except that the 5% polyvinyl alcohol (oxygen permeability constant $0.9\times10^{-12}cm^3\cdot cm/cm^2\cdot sec\cdot cmHg$) aqueous solution was replaced with a 40% polyvinyl acetate (oxygen permeability constant $0.5\times10^{-10}cm^3\cdot cm/cm^2\cdot sec\cdot cmHg$ or less) aqueous emulsion.

Example 7

A heat-sensitive recording material as shown in FIG. 5 was prepared in the following manner. A 5% polyvinyl alcohol (oxygen permeability constant $0.9\times10^{-12}cm^3\cdot cm/cm^2\cdot sec\cdot cmHg$) aqueous solution was applied to a base paper sheet 1 having a basis weight of 40 $g/m^2$ with a wire bar so as to form a coating having a dry weight of 2.0 $g/m^2$, and dried, whereby an oxygen-barrier layer 4*b* was formed. Further, the above coating liquid for an intermediate layer was applied to the same surface so as to form a coating having a dry weight of 5.0 $g/m^2$, and dried, whereby the intermediate layer 3 was formed on the oxygen-barrier layer 4*b*. The above coating liquid for a heat-sensitive recording layer was applied with a wire bar so as to form coating having a dry weight of 3.0 $g/m^2$, and dried, whereby the heat-sensitive recording layer 2 was formed on the intermediate layer 3. A 5% polyvinyl alcohol (oxygen permeability constant $0.9\times10^{-12}cm^3\cdot cm/cm^2\cdot sec\cdot cmHg$) aqueous solution was applied with a wire bar so as to form a coating having a dry weight of 2.0 $g/m^2$, and dried, whereby another oxygen-barrier layer 4*a* was formed on the heat-sensitive recording layer 2. The resultant coating was treated with a super calender to give the heat-sensitive recording material as shown in FIG. 5.

Example 8

A heat-sensitive recording material as shown in FIG. 4 was prepared in the following manner. The above coating liquid for an intermediate layer was applied to a base paper sheet 1 having a basis weight of 40 $g/m^2$ so as to form a coating having a dry weight of 5.0 $g/m^2$, and dried. Further, a 5% polyvinyl alcohol (oxygen permeability constant $0.9\times10^{-12}cm^3\cdot cm/cm^2\cdot sec\cdot cmHg$) aqueous solution was applied to the same surface with a wire bar so as to form a coating having a dry weight of 2.0 $g/m^2$, and dried, whereby an oxygen-barrier layer 4*b* was formed on the intermediate layer 3. The above coating liquid for a heat-sensitive recording layer was applied with a wire bar so as to form a coating having a dry weight of 3.0 $g/m^2$, and dried, whereby the heat-sensitive recording layer 2 was formed on the oxygen-barrier layer 4*b*. A 5% polyvinyl alcohol (oxygen permeability constant $0.9\times10^{-12}cm^3\cdot cm/cm^2\cdot sec\cdot cmHg$) aqueous solution was applied with a wire bar so as to form a coating having a dry weight of 2.0 $g/m^2$, and dried, whereby another oxygen-barrier layer 4*a* was formed on the heat-sensitive recording layer 2. The resultant coating was treated with a super calender to give the heat-sensitive recording material as shown in FIG. 4.

Example 9

A heat-sensitive recording material as shown in FIG. 3 was obtained in the same manner as in Example 4 except that the amount of the 5% polyvinyl alcohol aqueous solution was changed each time so as to form a coating having a dry weight of 4 $g/m^2$ each time.

Example 10

A heat-sensitive recording material as shown in FIG. 3 was obtained in the same manner as in Example 5 except that the amount of the 40% polyvinylidene chloride aqueous emulsion was changed each time so as to form a coating having a dry weight of 4 $g/m^2$ each time.

Example 11

A heat-sensitive recording material as shown in FIG. 3 was obtained in the same manner as in Example 6 except that the amount of the 40% polyvinyl acetate aqueous emulsion was changed each time so as to form a coating having a dry weight of 4 $g/m^2$ each time.

Example 12

A heat-sensitive recording material as shown in FIG. 3 was prepared in the following manner. A 40% polyvinylidene chloride (oxygen permeability constant $0.5\times10^{-12}cm^3\cdot cm/cm^2\cdot sec\cdot cmHg$) aqueous emulsion was applied to a base paper sheet 1 having a basis weight of 40 $g/m^2$ with a wire bar so as to form a coating having a dry weight of 4.0 $g/m^2$, and dried, whereby an oxygen-barrier layer 4*b* was formed. Further, the above coating liquid for a heat-sensitive recording layer was applied to the same surface so as to form a coating having a dry weight of 3.0 $g/m^2$, and dried, whereby the heat-sensitive recording layer 2 was formed on the oxygen-barrier layer 4*b*. A 5% polyvinyl alcohol (oxygen permeability constant $0.9\times10^{-12}cm^3\cdot cm/cm^2\cdot sec\cdot cmHg$) aqueous solution was applied with a wire bar so as to form coating having a dry weight of 4.0 $g/m^2$, and dried, whereby another oxygen-barrier layer 4*a* was formed on the heat-sensitive recording layer 2. The resultant coating was treated with a super calender to give the heat-sensitive recording material as shown in FIG. 3.

Example 13

A heat-sensitive recording material as shown in FIG. 3 was obtained in the same manner as in Example 4 except that the amount of the 5% polyvinyl alcohol aqueous solution was changed each time so as to form a coating having a dry weight of 8 $g/m^2$ each time.

Example 14

A heat-sensitive recording material as shown in FIG. 1 was prepared in the following manner. A 8% polyvinyl alcohol (oxygen permeability constant $0.9\times10^{-12}cm^3\cdot cm/cm^2\cdot sec\cdot cmHg$) aqueous solution was applied to a base paper sheet 1 having a basis weight of 40 $g/m^2$ with a wire bar so as to form a coating having a dry weight of 5.0 $g/m^2$, whereby an oxygen-barrier layer 4*b* was formed. An ethylene-vinyl alcohol copolymer film (15 $g/m^2$, oxygen permeability constant $0.7\times10^{-14}cm^3\cdot cm/cm^2\cdot sec\cdot cmHg$) was tightly attached, and the resultant set was dried.

Then, the above coating liquid for a heat-sensitive recording layer was applied to the surface not coated with the polyvinyl alcohol, so as to form a coating having a dry weight of 3.0 $g/m^2$, and dried, whereby the heat-sensitive recording layer 2 was formed on the base paper 1. A 8% polyvinyl alcohol (oxygen permeability constant $0.9\times10^{-12}cm^3\cdot cm/cm^2\cdot sec\cdot cmHg$) aqueous solution was applied with a wire bar so as to form a coating having a dry weight of 5.0 g/m$^2$, whereby another oxygen-barrier layer 4*a* was formed on the heat-sensitive recording layer 2. An ethylene-vinyl alcohol copolymer film (15 g/m$^2$, oxygen permeability constant $0.7\times10^{-14}$cm$^3$·cm/cm$^2$·sec·cmHg) was tightly attached, and the resultant set was dried to give the heat-sensitive recording material as shown in FIG. 1.

Comparative Example 1

The above coating liquid for a heat-sensitive recording layer was applied to a base paper sheet having a basis weight of 40 g/m$^2$ with a wire bar so as to form a coating having a dry weight of 3.0 g/m$^2$, and dried, whereby the heat-sensitive recording layer was formed on the base paper. The resultant coating was treated with a super calender to give a heat-sensitive recording material having no oxygen-barrier.

Comparative Example 2

The above coating liquid for an intermediate layer was applied to a base paper sheet having a basis weight of 40 g/m$^2$ with a wire bar so as to form a coating having a dry weight of 5.0 g/m$^2$, and dried, whereby the intermediate layer was formed on the base paper. The above coating liquid for a heat-sensitive recording layer was applied with a wire bar so as to form a coating having a dry weight of 3.0 g/m$^2$, and dried, whereby the heat-sensitive recording layer was formed on the intermediate layer. The resultant coating was treated with a super calender to give a heat-sensitive recording material having no oxygen-barrier layer.

Comparative Example 3

The above coating liquid for a heat-sensitive recording layer was applied to a base paper sheet having a basis weight of 40 g/m$^2$ with a wire bar so as to form a coating having a dry weight of 3.0 g/m$^2$, and dried, whereby the heat-sensitive recording layer was formed. A 5% polyvinyl alcohol (oxygen permeability constant $0.9\times10^{-12}$cm$^3$·cm/cm$^2$·sec·cmHg) aqueous solution was applied with a wire bar so as to form a coating having a dry weight of 2.0 g/m$^2$, and dried, whereby an oxygen-barrier layer was formed on the heat-sensitive recording layer. The resultant coating was treated with a super calender to give a heat-sensitive recording material having only one oxygen-barrier layer on the heat-sensitive recording layer.

Comparative Example 4

A 5% polyvinyl alcohol (oxygen permeability constant $0.9\times10^{-12}$cm$^3$·cm/cm$^2$·sec·cmHg) aqueous solution was applied to a base paper sheet having a basis weight of 40 g/m$^2$ with a wire bar so as to form a coating having a dry weight of 2.0 g/m$^2$, and dried, whereby an oxygen-barrier layer was formed. The above coating liquid for a heat-sensitive recording layer was applied with a wire bar so as to form a coating having a dry weight of 3.0 g/m$^2$, and dried, whereby the heat-sensitive recording layer was formed on the oxygen-barrier layer. The resultant coating was treated with a super calender to give a heat-sensitive recording material having only one oxygen-barrier layer between the base paper and the heat-sensitive recording layer.

Comparative Example 5

A 5% polyvinyl alcohol (oxygen permeability constant $0.9\times10^{-12}$cm$^3$·cm/cm$^2$·sec·cmHg) aqueous solution was applied to a base paper sheet having a basis weight of 40 g/m$^2$ with a wire bar so as to form a coating having a dry weight of 2.0 g/m$^2$, and dried, whereby an oxygen-barrier layer was formed. Further, the above coating liquid for a heat-sensitive recording layer was applied to the surface not coated with the polyvinyl alcohol, so as to form a coating having a dry weight of 3.0 g/m$^2$, and dried, whereby the heat-sensitive recording layer was formed on the base paper. The resultant set was treated with a super calender to give a heat-sensitive recording material having only one oxygen-barrier layer on the base papher.

Comparative Example 6

A heat-sensitive recording material was obtained in the same manner as in Example 1 except that the dry weight of the coating of polyvinyl alcohol was changed to 1.0 g/m$^2$ each time to form oxygen-barrier layers each having a basis weight of 1.0 g/m$^2$ which is smaller than 2 g/m$^2$.

Comparative Example 7

A heat-sensitive recording material was obtained in the same manner as in Example 2 except that the dry weight of the coating of polyvinylidene chloride was changed to 1.0 g/m$^2$ each time to form oxygen-barrier layers each having a basis weight of 1.0 g/m$^2$ which is smaller than 2 g/m$^2$.

Comparative Example 8

A heat-sensitive recording material was obtained in the same manner as in Example 4 except that the 5% polyvinyl alcohol (oxygen permeability constant $0.9\times10^{-12}$cm$^3$·cm/cm$^2$·sec·cmHg) aqueous solution was replaced with a 40% polybutadiene-acrylonitrile copolymer (oxygen permeability constant $0.39\times10^{-9}$cm$^3$·cm/cm$^2$·sec·cmHg) aqueous emulsion to form oxygen-barrier layers each having an oxygen permeability constant of larger than $0.5\times10^{-10}$cm$^3$·cm/cm$^2$·sec·cmHg.

Comparative Example 9

A heat-sensitive recording material was obtained in the same manner as in Example 4 except that the 5% polyvinyl alcohol (oxygen permeability constant $0.9\times10^{-12}$cm$^3$·cm/cm$^2$·sec·cmHg) aqueous solution was replaced with a 30% natural rubber (oxygen permeability constant $0.23\times10^{-8}$cm$^3$·cm/cm$^2$·sec·cmHg) aqueous latex to form oxygen-barrier layers each having an oxygen permeability constant of larger than $0.5\times10^{-10}$cm$^3$·cm$^2$·sec·cmHg.

The printed surfaces of the heat-sensitive recording materials obtained in the above Examples 1 to 14 and Comparative Examples 1 to 9 were measured for sensory chromatically L*a*b* values with a luminance meter (CR-200, supplied by Minolta Camera Co., Ltd.). Then, samples having a size of 5 cm×5 cm were prepared by cutting the heat-sensitive recording materials and affixed to a wall indoors such that the printed surfaces were outside. After 60 days, the printed surfaces were again measured for sensory chromaticity L*a*b* values with the luminance meter (CR-200, supplied by Minolta Camera Co., Ltd.), to determine color differences ΔE*a*b* values between the chromaticity L*a*b* values before the test and the chromaticity L*a*b* values after the test. Tables 1 and 2 show the so-determined color difference ΔE*a*b* values. The ΔE*a*b* value is required to be 2.5 or less, and it is preferably 1.5 or less.

TABLE 1

| Example | Corresponding Figure | Color difference ΔE*a*b* |
|---|---|---|
| 1 | FIG. 1 | 2.20 |
| 2 | FIG. 1 | 2.13 |
| 3 | FIG. 2 | 2.32 |
| 4 | FIG. 3 | 1.20 |
| 5 | FIG. 3 | 1.15 |
| 6 | FIG. 3 | 1.38 |
| 7 | FIG. 5 | 1.26 |
| 8 | FIG. 4 | 1.21 |
| 9 | FIG. 3 | 0.59 |
| 10 | FIG. 3 | 0.62 |
| 11 | FIG. 3 | 0.91 |
| 12 | FIG. 3 | 0.58 |
| 13 | FIG. 3 | 0.43 |
| 14 | FIG. 1 | 0.84 |

TABLE 2

| Comparative Example | Color difference ΔE*a*b* |
|---|---|
| 1 | 6.29 |
| 2 | 6.18 |
| 3 | 4.15 |
| 4 | 5.36 |
| 5 | 6.01 |
| 6 | 4.02 |
| 7 | 4.38 |
| 8 | 3.89 |
| 9 | 4.34 |

The above Table 1 shows the following. The heat-sensitive recording materials which have features in that the heat-sensitive recording layer is formed between the oxygen-barrier layers having a basis weight of 2 to 20 g/m$^2$ each and that the oxygen-barrier layers are formed of the polymer substance having an oxygen permeability constant of $0.5\times10^{-10}$cm$^3$·cm/cm$^2$·sec·cmHg or less, obtained in Examples 1 to 14, show ΔE*a*b* values of less than 2.5 and are excellent in the light resistance in a non-printed portion.

Further, of the heat-sensitive recording materials having the two oxygen-barrier layers having a basis weight of 2 g/m$^2$ each, obtained in Examples 1 to 8, the heat-sensitive recording materials having the heat-sensitive recording layer alone between the two oxygen-barrier layers, obtained in Examples 4, 5, 6 and 8, and the heat-sensitive recording material having the intermediate layer and the heat-sensitive recording layer alone between the two oxygen-barrier layers, obtained in Example 7 show ΔE*a*b* values of less than 1.5, and these heat-sensitive recording materials obtained in Examples 4 to 8 are excellent in the light resistance in a non-printed portion over the heat-sensitive recording materials having the substrate and the heat-sensitive recording layer between the two oxygen-barrier layers, obtained in Examples 1 and 2 and the heat-sensitive recording material having the substrate, the intermediate layer and the heat-sensitive recording layer between the two oxygen-barrier layers, obtained in Example 3.

On the other hand, Table 2 shows the following. The heat-sensitive recording materials having no oxygen-barrier layer, obtained in Comparative Examples 1 and 2 and the heat-sensitive recording materials having one oxygen-barrier layer alone, obtained in Comparative Examples 3 to 5, show ΔE*a*b* values of larger than 2.5 and have insufficient light resistance in a non-printed portion. Further, the heat-sensitive recording materials which have the two oxygen-barrier layers but of which the oxygen-barrier layers have a dry weight of less than 2 g/m$^2$ each, obtained in Comparative Examples 6 and 7, show ΔE*a*b* values of larger than 2.5 and have insufficient light resistance in a non-printed portion.

Further, the heat-sensitive recording materials which have the heat-sensitive recording layer between the two oxygen-barrier layers having a basis weight of 2 to 20 g/m$^2$ but of which the oxygen-barrier layers are formed of the polymer substance having an oxygen permeability constant of larger than $0.5\times10^{-10}$cm$^3$·cm/cm$^2$·sec·cmHg, obtained in Comparative Examples 8 and 9, show ΔE*a*b* values of larger than 2.5 and have insufficient light resistance in a non-printed portion.

<Heat-sensitive recording material according to the second embodiment>

Example 15

A coating liquid having the following contents was applied to a base paper sheet having a basis weight of 40 g/m$^2$ with a wire bar so as to form a coating having a dry weight of 15 g/m$^2$, and dried, whereby an laminated sheet was prepared which consists of the base paper and an oxygen-barrier layer.

| | |
|---|---|
| 20% Polystyrene fine particles aqueous dispersion | 7 parts |
| 10% Polyvinyl alcohol aqueous solution | 26 parts |
| Water | 7 parts |

The above-prepared laminated sheet was measured for an oxygen permeability to show 950 cm$^3$/m$^2$·24 hr·atm.

Further, the above coating liquid for a heat-sensitive recording layer was applied to the oxygen-barrier layer surface so as to form a coating having a dry weight of 3.0 g/m$^2$ and dried, whereby the heat-sensitive recording layer was formed on the oxygen-barrier layer. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 380 cm$^3$/m$^2$·24 hr·atm, which value is smaller than the value obtained by multiplying the oxygen permeability of the laminated sheet by 0.5.

Example 16

A coating liquid having the following contents was applied to a base paper sheet having a basis weight of 40 g/m$^2$ with a wire bar so as to form a coating having a dry weight of 15 g/m$^2$, and dried, whereby a laminated sheet was prepared which consists of the base paper and an oxygen-barrier layer.

| | |
|---|---|
| 20% Polystyrene fine particles aqueous dispersion | 10 parts |
| 40% Polyvinyl acetate aqueous emulsion | 15 parts |
| Water | 15 parts |

The above-prepared laminated sheet was measured for an oxygen permeability to show 840 cm$^3$/m$^2$·24 hr·atm.

Further, the above coating liquid for a heat-sensitive recording layer was applied to the oxygen-barrier layer surface so as to form a coating having a dry weight of 3.0 g/m$^2$ and dried, whereby the heat-sensitive recording layer was formed on the oxygen-barrier layer. A 40% polyvinyl acetate aqueous emulsion was applied with a wire bar so as to form a coating having a dry weight of 4.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 125 cm$^3$/m$^2$·24 hr·atm, which value is smaller than the value obtained by multiplying the oxygen permeability of the laminated sheet by 0.5.

Example 17

A laminated sheet having an oxygen permeability constant of 950 cm$^3$/m$^2$·24 hr·atm was prepared in the same manner as in Example 15. Then, the above coating liquid for a heat-sensitive recording layer was applied to the surface not coated with the oxygen-barrier layer, so as to form a coating having a dry weight of 3.0 g/m$^2$, and dried, whereby the heat-sensitive recording layer was formed on the base paper. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 420 cm$^3$/m$^2$·24 hr·atm, which value is smaller than the value obtained by multiplying the oxygen permeability of the laminated sheet by 0.5.

Example 18

A coating liquid having the following contents was applied to a base paper sheet having a basis weight of 40 g/m$^2$ with a wire bar so as to form a coating having a dry weight of 15 g/m$^2$, and dried, whereby a laminated sheet was prepared which consists of the base paper and an oxygen-barrier layer.

| | |
|---|---|
| 20% Polystyrene fine particles aqueous dispersion | 5 parts |
| 10% Polyvinyl alcohol aqueous solution | 30 parts |
| Water | 5 parts |

The above-prepared laminated sheet was measured for an oxygen permeability to show 430 cm$^3$/m$^2$·24 hr·atm.

Further, the above coating liquid for a heat-sensitive recording layer was applied to the oxygen-barrier layer surface so as to form a coating having a dry weight of 3.0 g/m$^2$ and dried, whereby the heat-sensitive recording layer was formed on the oxygen-barrier layer. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 160 cm$^3$/m$^2$·24 hr·atm, which value is smaller than the value obtained by multiplying the oxygen permeability of the laminated sheet by 0.5.

Example 19

A laminated sheet having an oxygen permeability constant of 430 cm$^3$/m$^2$·24 hr·atm was prepared in the same manner as in Example 18. Then, the above coating liquid for a heat-sensitive recording layer was applied to the oxygen-barrier layer surface so as to form a coating having adry-weight of 4.0 g/m$^2$, and dried, whereby the heat-sensitive recording layer was formed on the oxygen-barrier layer. A 8% polyvinyl alcohol aqueous solution was applied with a wire bar so as to form a coating having a dry weight of 4.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 40 cm$^3$/m$^2$·24 hr·atm, which value is smaller than the value obtained by multiplying the oxygen permeability of the laminated sheet by 0.5.

Example 20

A laminated sheet having an oxygen permeability constant of 430 cm$^3$/m$^2$·24 hr·atm was prepared in the same manner as in Example 18. Then, the above coating liquid for a heat-sensitive recording layer was applied to the surface not coated with the oxygen-barrier layer, so as to form a coating having a dry weight of 3.0 g/m$^2$, and dried, whereby the heat-sensitive recording layer was formed on the base paper. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 190 cm$^3$/m$^2$·24 hr·atm, which value is smaller than the value obtained by multiplying the oxygen permeability of the laminated sheet by 0.5.

Example 21

A 8% polyvinyl alcohol aqueous solution was applied to a base paper sheet having a basis weight of 40 g/m$^2$ with a wire bar so as to form a coating having a dry weight of 5.0 g/m$^2$, and dried, whereby a laminated sheet was prepared which consists of the base paper and an oxygen-barrier layer.

The so-obtained laminated sheet was measured for an oxygen permeability to show 26 cm$^3$/m$^2$·24 hr·atm.

Further, the above coating liquid for a heat-sensitive recording layer was applied to the polyvinyl alcohol coating surface of the laminated sheet so as to form a coating having a dry weight of 3.0 g/m$^2$ and dried, whereby the heat-sensitive recording layer was formed on the oxygen-barrier layer. A 8% polyvinyl alcohol aqueous solution was applied with a wire bar so as to form a coating having a dry weight of 5.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 11 cm$^3$/m$^2$·24 hr·atm, which value is smaller than the value obtained by multiplying the oxygen permeability of the laminated sheet by 0.5.

Example 22

A 8% polyvinyl alcohol aqueous solution was applied to a base paper sheet having a basis weight of 40 g/m$^2$ with a wire bar so as to form a coating having a dry weight of 6.0 g/m$^2$, and dried, whereby a laminated sheet consisting of the base paper and an oxygen-barrier layer was prepared.

The so-obtained laminated sheet was measured for an oxygen permeability to show 10 cm$^3$/m$^2$·24 hr·atm.

Further, the above coating liquid for a heat-sensitive recording layer was applied to the surface not coated with the polyvinyl alcohol, so as to form a coating having a dry weight of 3.0 g/m$^2$ and dried, whereby the heat-sensitive recording layer was formed on the base paper.

And a 8% polyvinyl alcohol aqueous solution was applied with a wire bar so as to form a coating having a dry weight of 4.0 g/m$^2$, whereby another oxygen-barrier layer was formed on the heat-sensitive recording layer. An ethylene-vinyl alcohol copolymer film was tightly attached thereto. The resultant set was dried to give a heat-sensitive recording material.

The above-obtained heat-sensitive recording material was measured for an oxygen permeability to show 0.7 cm$^3$/m$^2$·24 hr·atm, which value is smaller than the value obtained by multiplying the oxygen permeability of the laminated sheet by 0.5.

Example 23

The above coating liquid for an intermediate layer was applied to a base paper sheet having a basis weight of 40 g/m$^2$ with a wire bar so as to form a coating having a dry weight of 5.0 g/m$^2$.

Then, a coating liquid having the following contents was applied to the intermediate layer surface with a wire bar so as to form a coating having a dry weight of 15 g/m$^2$, and dried, whereby a laminated sheet was prepared which consists of the base paper, the intermediate layer and an oxygen-barrier layer.

| | |
|---|---|
| 20% Polystyrene fine particles aqueous dispersion | 7 parts |
| 10% Polyvinyl alcohol aqueous solution | 26 parts |
| Water | 7 parts |

The above-prepared laminated sheet was measured for an oxygen permeability to show 890 cm$^3$/m$^2$·24 hr·atm.

Further, the above coating liquid for a heat-sensitive recording layer was applied to the oxygen-barrier layer surface so as to form a coating having a dry weight of 3.0 g/m$^2$ and dried, whereby the heat-sensitive recording layer was formed on the oxygen-barrier layer. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 360 cm$^3$/m$^2$·24 hr·atm, which value is smaller than the value obtained by multiplying the oxygen permeability of the laminated sheet by 0.5.

Example 24

A coating liquid having the following contents for a protective layer was applied to the same heat-sensitive recording material as that obtained in Example 21 with a wire bar so as to form a coating having a dry weight of 1.0 g/m$^2$ and dried. The resultant set was treated with a super calender to give a heat-sensitive recording material.

| | |
|---|---|
| 20% Calcium carbonate dispersion | 10 parts |
| 40% Zinc stearate dispersion | 3 parts |
| 20% Acrylic latex | 4 parts |
| Water | 3 parts |

The so-obtained heat-sensitive recording material was measured for an oxygen permeability to show 12 cm$^3$/m$^2$·24 hr·atm, which value is smaller than the value obtained by multiplying the oxygen permeability (26 cm$^3$/m$^2$·24 hr·atm) of the laminated sheet by 0.5.

Example 25

A coating liquid having the following contents for a protective layer was applied to the same heat-sensitive recording material as that obtained in Example 23 with a wire bar so as to form a coating having a dry weight of 1.0 g/m$^2$ and dried. The resultant set was treated with a super calender to give a heat-sensitive recording material.

| | |
|---|---|
| 20% Calcium carbonate dispersion | 10 parts |
| 40% Zinc stearate dispersion | 3 parts |
| 20% Acrylic latex | 4 parts |
| Water | 3 parts |

The so-obtained heat-sensitive recording material was measured for an oxygen permeability to show 340 cm$^3$/m$^2$·24 hr·atm, which value is smaller than the value obtained by multiplying the oxygen permeability (890 cm$^3$/m$^2$·24 hr·atm) of the laminated sheet by 0.5.

Comparative Example 10

A coating liquid having the following contents was applied to a base paper sheet having a basis weight of 40 g/m$^2$ with a wire bar so as to form a coating having a dry weight of 15 g/m$^2$, and dried.

| | |
|---|---|
| 20% Polystyrene fine particles aqueous dispersion | 8 parts |
| 10% Polyvinyl alcohol aqueous solution | 24 parts |
| Water | 8 parts |

The above-prepared laminated sheet was measured for an oxygen permeability to show 2,510 cm$^3$/m$^2$·24 hr·atm which is out of the claimed range of 1,000 cm$^3$/m$^2$·24 hr·atm or less.

Further, the above coating liquid for a heat-sensitive recording layer was applied to the oxygen-barrier layer surface so as to form a coating having a dry weight of 3.0 g/m$^2$ and dried, whereby the heat-sensitive recording layer was formed on the oxygen-barrier layer. A 8% polyvinyl alcohol aqueous solution was applied with a wire bar so as to form a coating having a dry weight of 3.0 g/m$^2$ and dried, whereby another oxygen-barrier layer was formed on the heat-sensitive recording layer. The resultant set was treated with a super calender to give a heat-sensitive recording material.

The above-obtained heat-sensitive recording material was measured for an oxygen permeability to show 520 $cm^3/m^2 \cdot 24$ hr·atm, which value is smaller than the value obtained by multiplying the oxygen permeability of the laminated sheet by 0.5.

Comparative Example 11

A laminated sheet (oxygen permeability 26 $cm^3/m^2 \cdot 24$ hr·atm) was prepared in the same manner as in Example 21. Then, the above coating liquid for a heat-sensitive recording layer was applied to the coated surface of the laminated sheet so as to form a coating (the heat-sensitive recording layer) having a dry weight of 3.0 $g/m^2$ and dried, and further, a coating liquid having the following contents was applied with a wire bar so as to form a coating(another oxygen-barrier layer) having a dry weight of 5.0 $g/m^2$ and dried. The resultant set was treated with a super calender to give a heat-sensitive recording material.

| | |
|---|---|
| 20% Polystyrene fine particles aqueous dispersion | 8 parts |
| 10% Polyvinyl alcohol aqueous solution | 24 parts |
| Water | 8 parts |

The above-obtained heat-sensitive recording material was measured for an oxygen permeability to show 22 $cm^3/m^2 \cdot 24$ hr·atm, which value is larger than the value obtained by multiplying the oxygen permeability of the laminated sheet by 0.5.

The printed surfaces of the heat-sensitive recording materials obtained in the above Examples 15 to 25 and Comparative Examples 10 and 11 were measured for sensory chromaticity L*a*b* values with a luminance meter (CR-200, supplied by Minolta Camera Co., Ltd.). Then, samples having a size of 5 cm×5 cm were prepared by cutting the heat-sensitive recording materials and affixed to a wall indoors such that the printed surfaces were outside. After 60 days, the printed surfaces were again measured for sensory chromaticity L*a*b* values with the luminance meter (CR-200, supplied by minolta Camera Co., Ltd.), to determine color differences ΔE*a*b* values between the chromaticity L*a*b* values before the test and the chromaticity L*a*b* values after the test. Table 3 shows the so-determined color difference ΔE*a*b* values. The ΔE*a*b* value is required to be 2.5 or less, and it is preferably 1.5 or less.

TABLE 3

| Example (Ex.) and Comparative Example (CEx.) | Oxygen permeability ($cm^3/m^2 \cdot 24$ hr · atm) Laminated sheet | Heat-sensitive recording material | Color difference (ΔE*a*b*) |
|---|---|---|---|
| Ex. 15 | 950 | 380 | 2.12 |
| Ex. 16 | 840 | 125 | 1.88 |
| Ex. 17 | 950 | 420 | 2.41 |
| Ex. 18 | 430 | 160 | 1.12 |
| Ex. 19 | 430 | 40 | 0.95 |
| Ex. 20 | 430 | 190 | 1.42 |
| Ex. 21 | 26 | 11 | 0.49 |
| Ex. 22 | 10 | 0.7 | 0.80 |
| Ex. 23 | 890 | 360 | 1.83 |
| Ex. 24 | 26 | 12 | 0.52 |
| Ex. 25 | 890 | 340 | 1.69 |
| CEx. 10 | 2,510 | 520 | 3.57 |
| CEx. 11 | 26 | 22 | 4.21 |

Table 3 shows the following. In Examples 15 to 25, the laminated sheets have an oxygen permeability of less than 1,000 $cm^3/m^2 \cdot 24$ hr·atm and the oxygen permeability of each heat-sensitive recording material obtained by forming the heat-sensitive recording layer and the oxygen-barrier layer on the laminated sheet is smaller than the value obtained by multiplying the oxygen permeability of the laminated sheet by 0.5. The heat-sensitive recording materials obtained in those Examples 15 to 25 have ΔE*a*b* values of less than 2.5 and have excellent heat resistance in a non-printed portion.

Further, in Examples 18 to 22 and 24, the laminated sheets have an oxygen permeability of less than 500 $cm^3/m^2 \cdot 24$ hr·atm, and the oxygen permeability of each heat-sensitive recording material obtained by forming the heat-sensitive recording layer and the oxygen-barrier layer on the laminated sheet is smaller than the value obtained by multiplying the oxygen permeability of the laminated sheet by 0.5. The heat-sensitive recording materials obtained in those Examples 18 to 22 and 24 have ΔE*a*b* values of less than 1.5 and have further excellent heat resistance in a non-printed portion.

On the other hand, in Comparative Example 10, the heat-sensitive recording material of which the laminated sheet has an oxygen permeability of larger than 1,000 $cm^3/m^2 \cdot 24$ hr·atm has a ΔE*a*b* value of larger than 2.5 and has insufficient light resistance in a non-printed portion.

Further, in Comparative Example, the laminated sheet has an oxygen permeability of less than 1,000 $cm^3/m^2 \cdot 24$ hr·atm, but the oxygen permeability of the heat-sensitive recording material obtained by forming the heat-sensitive recording layer and the oxygen-barrier layer on the laminated sheet is larger than the value obtained by multiplying the oxygen permeability of the laminated sheet by 0.5. The heat-sensitive recording material obtained in Comparative Example 11 also has a ΔE*a*b* value of larger than 2.5 and has insufficient light resistance in a non-printed portion.

As explained above, the present invention provides heat-sensitive recording materials having excellent light resistance in a non-printed portion and a process for the production thereof.

What is claimed is:

1. A heat-sensitive recording material in which a heat-sensitive recording layer which thermally forms a color is directly or indirectly formed on a substrate, the heat-sensitive recording layer being present between two oxygen-barrier layers each of which has a basis weight of 2 to 20 $g/m^2$, the oxygen-barrier layers being formed of a polymer substance having an oxygen permeability constant of $0.5 \times 10^{-10} cm^3 \cdot cm/cm^2 \cdot sec \cdot cmHg$ or less.

2. The heat-sensitive recording material of claim 1, wherein the heat-sensitive recording layer alone is present between the oxygen-barrier layers.

3. The heat-sensitive recording material of claim 1, wherein the heat-sensitive recording layer and an intermediate layer are present between the oxygen-barrier layers.

4. A heat-sensitive recording material in which a heat-sensitive recording layer which thermally forms a color is directly or indirectly formed on a substrate, which heat-sensitive recording material is obtained by forming an oxygen-barrier layer formed mainly of a polymer substance on one surface of the substrate to form a laminated sheet having an oxygen permeability of 1,000 $cm^3/m^2 \cdot 24$ hr·atm or less, then forming the heat-sensitive recording layer on the oxygen-barrier layer surface or the other surface of the substrate of the laminated sheet, and further forming other oxygen-barrier layer on the heat-sensitive recording layer surface to sandwich the heat-sensitive recording layer between the two oxygen-barrier layers, the heat-sensitive recording material having an oxygen permeability equivalent to, or smaller than, a value obtained by multiplying an oxygen permeability of the laminated sheet by 0.5.

5. The heat-sensitive recording material of claim 4, wherein the laminated sheet has an oxygen permeability of 500 $cm^3/m^2 \cdot 24$ hr·atm or less.

6. The heat-sensitive recording material of claim 4, wherein the polymer substance is polyvinyl alcohol or an ethylene-vinyl alcohol copolymer.

7. The heat-sensitive recording material of claim 4, wherein the heat-sensitive recording material is obtained by consecutively forming the first oxygen-barrier layer, the heat-sensitive recording layer and the second oxygen-barrier layer on the substrate.

8. The heat-sensitive recording material of claim 4, wherein the heat-sensitive recording material is obtained by consecutively forming an intermediate layer, the first oxygen-barrier layer, the heat-sensitive recording layer and the second oxygen-barrier layer on the substrate.

9. The heat-sensitive recording material of claim 7, wherein a protective layer is further formed on the second oxygen-barrier layer.

* * * * *